US005610481A

United States Patent [19]

Shirai et al.

[11] Patent Number: 5,610,481

[45] Date of Patent: Mar. 11, 1997

[54] CATHODE RAY TUBE WITH LOW DYNAMIC CORRECTION VOLTAGE

[75] Inventors: Shoji Shirai, Mobara; Kenichi Watanabe, Isumi-gun, both of Japan

[73] Assignee: Hitachi, Ltd., Tokyo, Japan

[21] Appl. No.: 262,975

[22] Filed: Jun. 21, 1994

[30] Foreign Application Priority Data

Jun. 30, 1993 [JP] Japan ..... 5-161913

[51] Int. Cl.[6] ..... G09G 1/04; H01J 29/50

[52] U.S. Cl. ..... 315/382; 313/414

[58] Field of Search ..... 315/382, 382.1; 313/414

[56] References Cited

U.S. PATENT DOCUMENTS 5,212,423 5/1993 Noguchi et al. ..... 313/414

5,394,512 1/1995 Kamohara et al. ..... 313/414

*Primary Examiner*—Gregory C. Issing

*Attorney, Agent, or Firm*—Antonelli, Terry, Stout & Kruas, LLP

[57] ABSTRACT

To correct a deterioration by a deflection aberration of an electron beam spot at a peripheral portion of an image plane and to promote the resolution, a cathode ray tube is proposed which is composed of an acceleration electrode and a first kind and a second kind of focusing electrode group which are applied with a first and a second focusing voltage, wherein a first electron lens in which a first focusing force for focusing the electron beam in the horizontal direction is always stronger than a second focusing force for focusing it in the vertical direction, and a second electron lens wherein the focusing force for focusing the electron beam in the horizontal direction or in the vertical direction is stronger than the other depending on the relative sizes of a first focusing voltage applied on the first kind of focusing electrode group and a second focusing voltage applied on the second kind of focusing electrode group, are formed among the first kind and the second kind of electrode group, and a dynamic voltage which changes in accordance with a deflection amount of the electron beam is superposed on a constant voltage, in either one of the first and the second focusing voltage.

12 Claims, 6 Drawing Sheets

CATHODE RAY TUBE WITH LOW DYNAMIC CORRECTION VOLTAGE

BACKGROUND OF THE INVENTION

The present invention relates to a cathode ray tube having an electron gun equipped with a main lens having a function of controlling a shape of an electron beam spot which is deflected to the peripheral portion of an display screen, to improve a resolution at the peripheral portion of the screen of the cathode ray tube for use in a direct view color television receiver or a color display terminal.

The cathode ray tube which is utilized in color display of a direct view type or projection type television receiver, display terminal device and the like, is composed of a panel portion that is an image screen, a neck portion accommodating an electron gun, and a funnel portion for connecting the panel portion and the neck portion. A deflection yoke is attached to the funnel portion for scanning an electron beam emitted from the electron gun on a phosphor screen that is formed on an inner face of the panel portion.

The electron gun which is accommodated in the neck portion is provided with an electron beam generating unit having a cathode for generating the electron beam and a control electrode for controlling the electron beam, and a main lens unit comprising various electrodes for focusing, accelerating and converging the controlled electron beam.

The electron beam emitted from the cathode is modulated by signals applied on the control electrode or the cathode, and is directed onto the phosphor screen after being formed into a required sectional shape and provided with a required energy by the main lens electrodes.

FIG. 5 shows a schematic sectional diagram for explaining an example of the structure of the color cathode ray tube, of which shape of the electron gun portion is exaggerated for the purpose of explanation.

In FIG. 5, the electron gun accommodated in the neck portion is composed of the electron beam generating unit and the main lens unit which accelerates and focuses the electron beam generated from the electron beam generating unit and the electron beam is made to impinge on a phosphor screen 3 composed of three color phosphor materials which are coated and formed on an inner wall of a faceplate portion 2 composing a glass envelope 1.

The electron beam generating unit is composed of cathodes 7, 8 and 9, a first grid electrode (G1)10, and a second grid electrode (G2)30. The electron beams which have been emitted from the cathodes 7, 8 and 9, are radiated along center axes 35, 36 and 37 which are disposed approximately in parallel with each other in a common plane (in the horizontal direction) and are incident on the main lens unit after passing through the first grid electrode 10 and the second grid electrode 30.

The main lens unit is composed of a third grid electrode (G3) 31 that is one main lens electrode, a fourth grid electrode (G4) 32 and a shield cup electrode 33. The center axes of electron beam passing holes 70, 71, 72, 76, 77 and 78 which are formed in the third grid electrode (G3) 31 and the shield cup electrode 33, are on the center axes 35, 36 and 37, respectively.

Further, the center axis of a central electron beam passing hole 74 of the fourth grid electrode 32 which is the other main lens electrode, is on the center axis 36. However, the center axes 38 and 39 of side electron beam passing holes 73 and 75 are not on the center axes 35 and 37, and are slightly displaced from the center axes 35 and 37 toward the outside, respectively.

In operation, the potential level of the third grid electrode 31 is set lower than that of the fourth grid electrode 32. The fourth grid electrode 32 and the shield cup electrode 33 having a high potential level is connected to a conductive film 5 such that the potential level thereof is equal to that of the conductive film 5 that is coated on the inner face of the funnel portion by a conductive spring or the like, not shown.

Since the center electron beam passing holes of the third grid electrode 31 and the fourth grid electrode 32 are coaxial, an axisymmetric main lens is formed at the central portions of the two electrodes, and the central electron beam is focused by the main lens and proceeds straight on a trajectory along the axis.

On the other hand, since the axes of the side electron beam passing holes of the two electrodes are deviated from each other, a non-axisymmetric main lens is formed at the side. Therefore, the outside electron beams pass through locations which are deviated from the center axes of the lens toward the central electron beam in a diverging lens region that is formed on the side of the fourth grid electrode 32, in the main lens region, and receive a focusing action by the main lens and at the same time a converging force toward the central electron beam.

In this way, the three the electron beams are focused and at the same time converged on a shadow mask 4 to be overlapped. This converging action is called a static convergence.

The electron beam receives a color selection at an opening of the shadow mask so that only a portion thereof passes through the opening to excite a phosphor of a color corresponding to the respective electron beam.

Further, the deflection yoke 6 deflects and scans the electron beam on the phosphor screen in the horizontal and vertical directions thereby forming a two-dimensional image on the phosphor screen.

Conventionally, an electron gun for a color picture tube having a so-called electrostatic quadrupole lens has been proposed to improve a resolution at a peripheral portion of the screen.

In the electron gun of this type, the cathode, the first grid electrode and the second grid electrode compose the electron beam generating unit, a plurality of electron beams are emitted from the electron beam generating unit along initial paths which are arranged approximately in parallel with each other in a horizontal plane, and are incident on the main lens unit composed of the focusing electrode, the accelerating electrode and the shield cup electrode.

The focusing electrode composing the main lens unit is composed of a first member and a second member, and the electrostatic quadrupole lens is composed by opposing an aperture electrode provided in the first member and planar correction electrodes provided in the second member.

The acceleration electrode is impressed with a final accelerating voltage of 20 through 35 kV that is the highest voltage. Further, a first focusing voltage is applied on the focusing electrode, which is normally a constant voltage of 5 through 10 kV.

On the other hand, a second focusing voltage is applied on the second member of the focusing electrode. The second focusing voltage comprises a constant voltage superposed by a dynamic correction voltage that changes in synchronism with a deflection amount of the electron beam.

The resolution at the peripheral portion of the screen of a color cathode ray tube is considerably improved by using the above electron gun. That is, a correction is performed wherein an astigmatism which elongates in the horizontal direction the electron beam spot that is deflected to the peripheral portion of the screen owing to a self-convergent magnetic deflection field and another astigmatism that elongates the electron beam formed by the electrostatic quadrupole lens in the vertical direction cancel each other.

The distance from the main lens to the center of the screen and the distance from the main lens to the peripheral portion of the screen are different. Therefore, when the electron beam is focused at the center of the image plane in an optimum condition, the focusing condition is deviated from the optimum condition at the peripheral portion of the screen, and this is a curvature-of-field aberration which brings about the deterioration in the resolution. The curvature-of-field aberration is corrected by the above-mentioned dynamic correction voltage, that is, when a dynamic correction voltage is applied, the intensity of the main lens which is a final stage lens formed between the accelerating electrode and the second member of the above-mentioned focusing electrode, is reduced, the deflected electron beam can be optimally focused at the peripheral portion of the screen, and the curvature-of-field aberration as well as the astigmatism are corrected.

However, when the electron gun having this electrostatic quadrupole lens is employed, an electric circuit for generating the dynamic correction voltage is necessary, which increases the production cost especially when the dynamic correction voltage is high. Accordingly, it is necessary to improve a correction sensitivity in deflection aberration.

When the strength of the electrostatic quadrupole lens is increased, the correction sensitivity of the astigmatism in the deflection aberration can easily be improved. However, with respect to the curvature-of-field aberration, the correction sensitivity can not be easily improved, since the curvature-of-field aberration is corrected by the main lens. When the strength of the main lens is increased to improve the correction sensitivity for curvature-of-field aberration, it is not possible to focus the electron beam on the screen, even when the electron beam is not deflected.

Even when the correction sensitivity with respect to only the astigmatism is improved, an unbalance thereof with a curvature-of-field correction is caused which does not result in the reduction of the dynamic correction voltage.

Accordingly, a structure of an electron gun for reducing the dynamic correction voltage and reducing the production cost has been proposed.

FIG. 6 is a schematic diagram for explaining a structure of an electron gun for improving the correction sensitivity in the astigmatism at a low cost without reducing the correction sensitivity for curvature of field, wherein numeral 8 designates a cathode, numeral 10 designates a first grid electrode, numeral 30 designates a second grid electrode, numeral 31 designates a focusing electrode group composing a third grid electrode, numeral 32 designates a fourth grid electrode composing an accelerating electrode, and numeral 33 designates a shield cup electrode.

As shown in FIG. 6, the focusing electrode 31 is divided into a plurality of electrode members 31-1, 31-2, 31-3, 31-4, 31-5 and 31-6. Among the members of a focusing electrode group, in addition to an electrostatic quadrupole lens, at least one axisymmetrical lens is provided which has a function of a curvature-of-field correction lens. Further, the main lens is provided with a strong astigmatism which deforms the sectional shape of the electron beam into the vertically elongated shape. On this occasion, it is necessary to change direct voltage components of two focusing voltages in the above-mentioned conventional electron gun. However, the method of applying the dynamic correction voltage remains the same.

That is, in the conventional gun, the two direct focusing voltages are approximately the same value, and the dynamic correction voltage increases with an increase in the deflection amount of the electron beam. On the other hand, in the electron gun shown in FIG. 6, one of the two direct focusing voltages is considerably made larger than the other, and the difference in voltages is at least larger than the maximum value of the dynamic correciton voltage. In this way, the difference in potential in the axisymmetric lens is reduced and the strength of lens is also reduced when the deflection amount of the electron beam and therefore the dynamic correction voltage increase.

Accordingly, a force for focusing the electron beam is weakened in deflecting the electron beam thereby correcting the curvature-of-field aberration.

In this way, at least one curvature-of-field correction lens is added to the conventional curvature-of-field correction lens that is conventionally provided with only the main lens. Therefore, it is possible to reduce the dynamic correction voltage.

Further, it is possible to reduce a voltage necessary for correction, also with respect to the correction of the astigmatism, by increasing the intensity of the electrostatic quadrupole lens or by increasing the number thereof.

In this way, in the color cathode ray tube employing the electron gun of the type shown in FIG. 6, the dynamic correction voltage can be reduced and the increase in the cost of the circuit can be restrained.

The electron gun employing the above electrostatic quadrupole lens has been disclosed in Japanese Laid Open Patent Publication No. 43532/1992.

However, in the color cathode ray tube employing the electron gun disclosed in the Japanese Laid Open Patent Publication No. 43532/1992, there is the following problem owing to the structure of electrodes of the electron gun.

The effect of correction for curvature of field by the above axisymmetric lens is weak in comparison with the effect by the main lens. Therefore, the focusing electrode should be divided into a number of electrodes and a number of, or actually 4 or 5 axisymmetric lenses should be formed to considerably reduce the dynamic correction voltage.

This brings about a complicated structure of the electron gun and the requirement for the accuracy in manufacturing it is very severe.

SUMMARY OF THE INVENTION

It is an object of the present invention to solve the above problem of the conventional technology and to provide a cathode ray tube which reduces the dynamic correction voltage of an electron gun using an electrostatic quadrupole lens by a simple structure thereby reducing a deterioration due to the deflection aberration of the electron beam spot at the peripheral portion of the screen, and improving the resolution. The above object is achieved by the present invention wherein a slit lens having a strong focusing effect in the horizontal direction, not an axisymmetric lens, is adopted for the curvature-of-field correction lens installed in the focusing electrode.

According to an aspect of the present invention, there is provided a cathode ray tube provided with at least an electron gun having an electron beam generating unit for generating a plurality of electron beams which are arrayed in a horizontal direction and are controlled and a main lens unit for making the plurality of electron beams which have been generated by the electron beam generating unit focus on a phosphor screen, and a deflection yoke for making the plurality of electron beams scan on the phosphor screen, said main lens unit of the electron gun comprising:

an accelerating electrode which is impressed with a final accelerating voltage; and a first kind of a focusing electrode group and a second kind of focusing electrode group which are impressed with at least two kinds of different focusing voltages of a first focusing voltage and a second focusing voltage;

wherein at least two non-axisymmetric electron lenses of a first electron lens wherein a first focusing force for focusing the plurality of electron beams in the horizontal direction is always stronger than a second focusing force for focusing the plurality of electron beams in a vertical direction, and a second electron lens wherein a focusing strength in one of the horizontal and the vertical directions for focusing the plurality of electron beams is stronger than that in the other according to which one of the first focusing voltage which is applied on the first kind of focusing electrode group and the second focusing voltage which is applied on the second kind of focusing electrode group, is higher, are formed between first electrode members composing the first kind of focusing electrode group and second electrode members composing the second kind of focusing electrode group;

wherein either one of the first focusing voltage and the second focusing voltage changes in synchronism with a deflection of the plurality of electron beams.

On this occasion, one direct voltage components of the first and the second focusing voltages is considerably larger than the other, and the difference in the voltages is at least larger than the maximum value of the dynamic correction.

According to another aspect of the present invention, there is provided the cathode ray tube according to the above aspect, wherein apertures are formed at both of opposing faces of mutually opposing electrodes in the first kind of electrode group and the second kind of electrode group composing the first non-axisymmetric electron lens, in which a diameter in the vertical direction is larger than a diameter in the horizontal direction.

The second non-axisymmetrical electrical lens is generally an electrostatic quadrupole lens and the first non-axisymmetrical electrode lens operates as a curvature-of-field correction lens.

Further, the object of the present invention can be achieved by rendering a curvature-of-field correction lens an axisymmetric lens and not necessarily a non-axisymmetric lens, and by arranging the curvature-of-field correction lens between the electrostatic quadrupole lens and the accelerating electrode on which a final accelerating voltage is applied. On this occasion, the effect of the present invention is increased further by rendering the curvature-of-field correction lens a non-axisymmetric lens.

According to another aspect of the present invention, there is provided a cathode ray tube provided with a beam generating unit for generating a plurality of electron beams which are arrayed in a horizontal direction and are controlled, and an electron gun at least having a main lens unit composed of a plurality of electrodes including a focusing electrode for focusing the plurality of electron beams from the beam generating unit on a phosphor screen and an acceleration electrode;

wherein the focusing electrode juxtaposed to the acceleration electrode wherein a highest voltage is applied, among the plurality of electrodes composing the main lens, comprises a plurality of divided electrode members;

wherein a second electron lens impressed with a first voltage which changes in synchronism with a deflection of the plurality of electron beams and a second voltage having a constant value for focusing the plurality of electron beams in either one of a horizontal direction and a vertical direction strong according to which one of the first voltage and the second voltage is higher than the other, is provided among the plurality of divided members composing the focusing electrode;

wherein at least one of a first axisymmetric or non-axisymmetric electron lenses wherein both ones of a first focusing force and a second focusing force for focusing the plurality of electron beams in the horizontal direction and in the vertical direction with an increase in a difference between the first voltage and the second voltage, when the first voltage and the second voltage are applied on the first electron lenses, is provided among the plurality of divided electrode members composing the focusing electrode;

wherein at least one of the first axisymmetric or non-axisymmetric electron lenses is provided between the second electron lens and the main lens.

On this occasion, one of the first and the second focusing voltages is a superposition of a constant voltage and a dynamic correction voltage which changes in accordance with a deflection amount of the electron beam, and one of the direct voltage components of the first and the second focusing voltages is considerably larger than the other, and the difference in voltage is at least larger than the maximum value of the dynamic correction voltage.

DESCRIPTION OF THE PREFERRED EMBODIMENT

Figure 6:
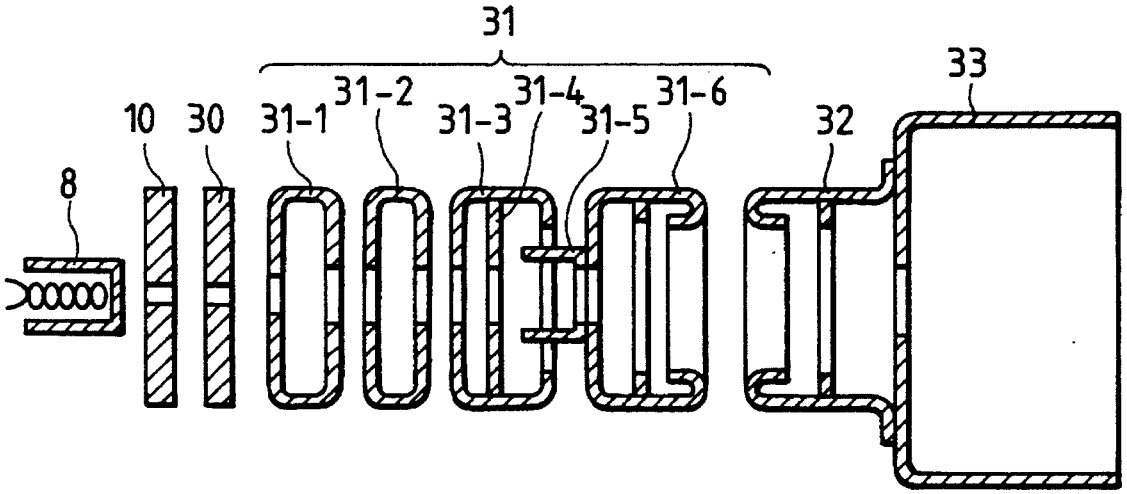
FIG. 6 is a schematic diagram for explaining a structure of an electron gun for improving a correction sensitivity of astigmatism at a low cost without reducing an effect of correcting curvature-of-field.
Figure 5:
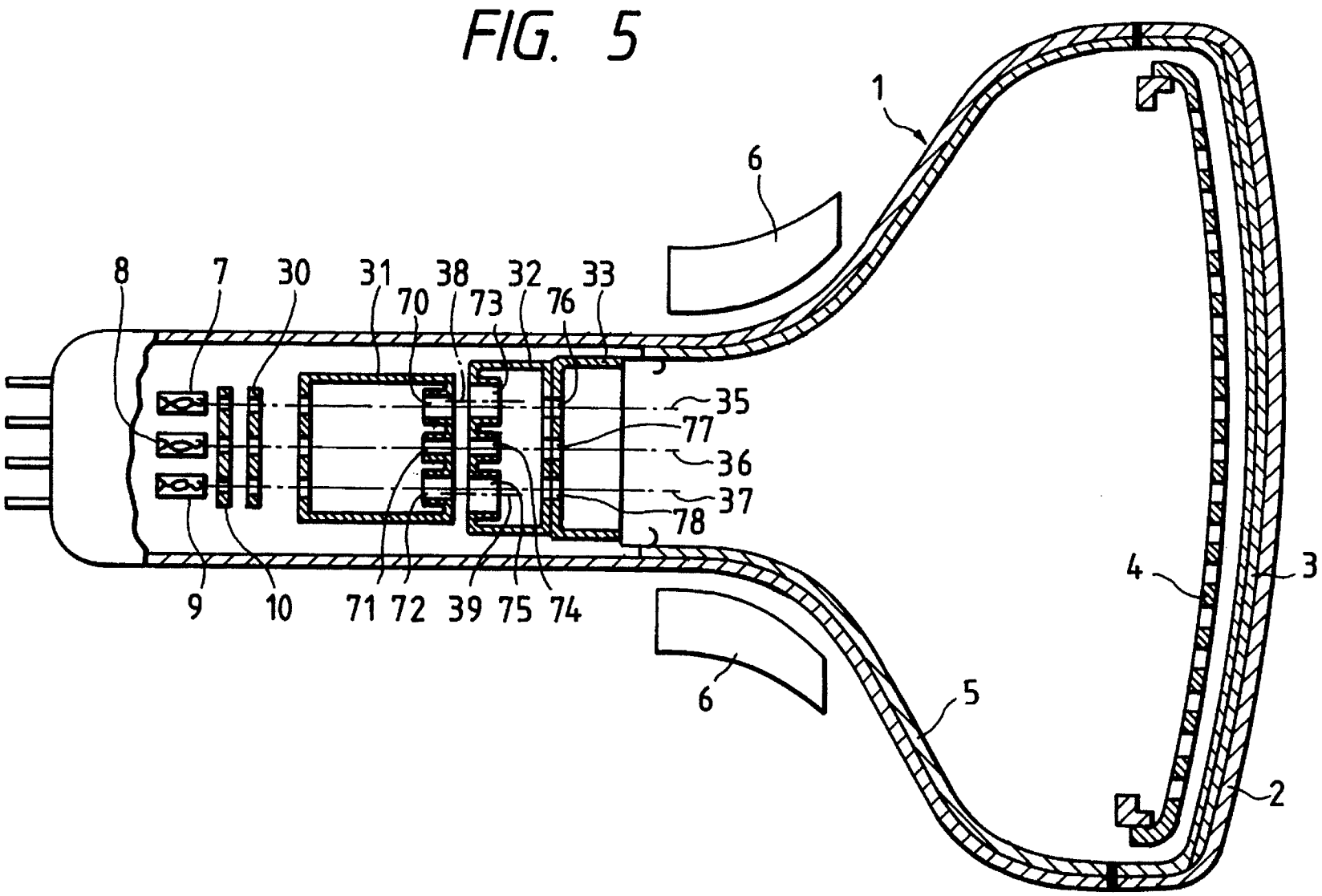
FIG. 5 is a schematic sectional diagram for explaining an example of a structure of a cathode ray tube.

In the conventional technology shown in FIG. 6, at the peripheral portion of the screen in which the dynamic correction voltage increases, in the horizontal direction the astigmatism correction by the electrostatic quadrupole lens has an effect of strengthening the focusing force for the electron beam, and the curvature-of-field correction by the main lens and the added axisymmetric lens has an effect of weakening the focusing force. On the other hand, in the vertical direction, both have an operation of weakening the focusing force for the electron beam.

Accordingly, the two kinds of lenses mutually weaken the effect in the horizontal direction and mutually strengthen it in the vertical direction.

In the construction of the present invention, the curvature-of-field correction lens is rendered to be a non-axisymmetric lens by which the focusing force is strengthened in the horizontal direction and weakened in the vertical direction thereby further compensating for the astigmatism in the vertical direction, improving the sensitivity of the curvature-of-field correction in the horizontal direction, and compensating for a portion of the correcting effect lessened, by the electrostatic quadrupole lens.

In this way, the two kinds of corrections of the astigmatism correction and the curvature-of-field correction can effectively be performed. Therefore, it is not necessary to provide a number of stages of the curvature-of-field correction lenses, and a color cathode ray tube having a high resolution can be provided at a low cost by simplifying the structure of the electron gun.

A detailed explanation will be given to embodiments of the present invention in reference to the drawings as follows.

Figure 1:
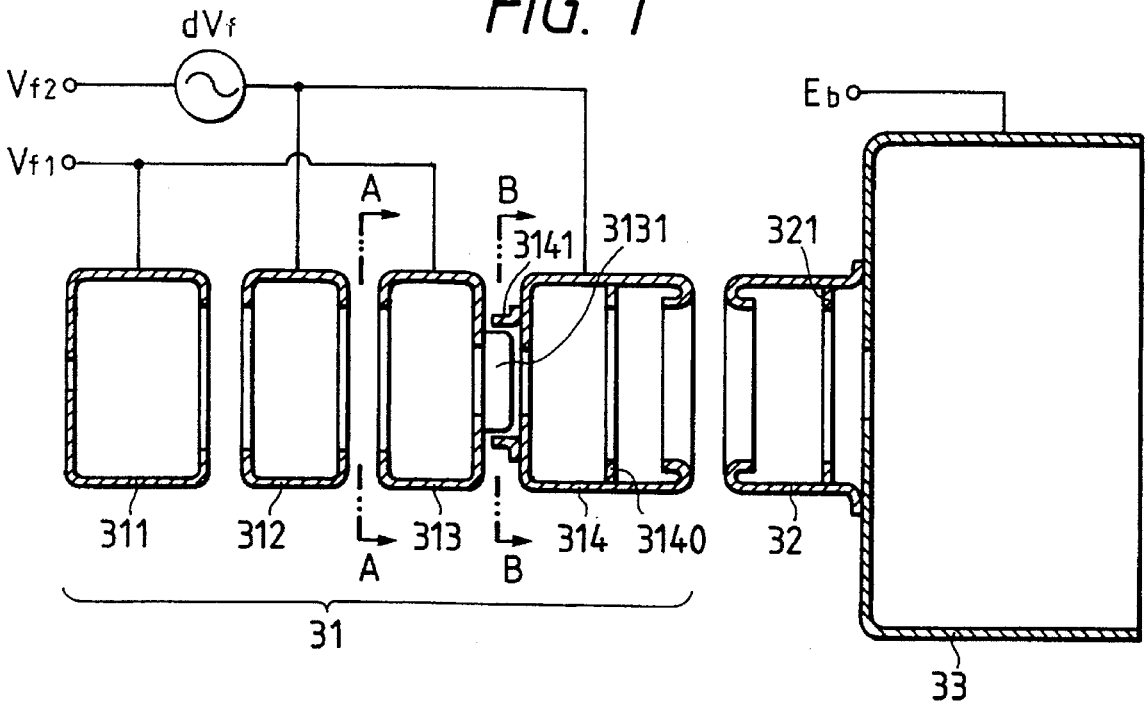
FIG. 1 is a longitudinal sectional diagram of important parts of a main lens unit for explaining a first embodiment of an electron gun provided to a cathode ray tube according to the present invention.
Figure 2:
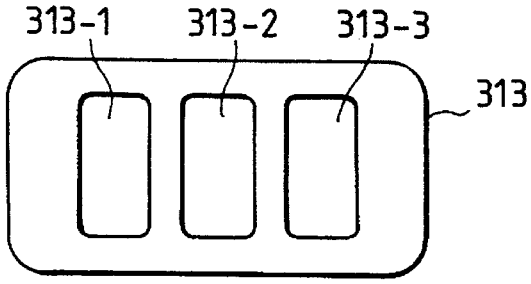
FIG. 2 is a sectional diagram taken along the line A—A of FIG. 1.
Figure 3:
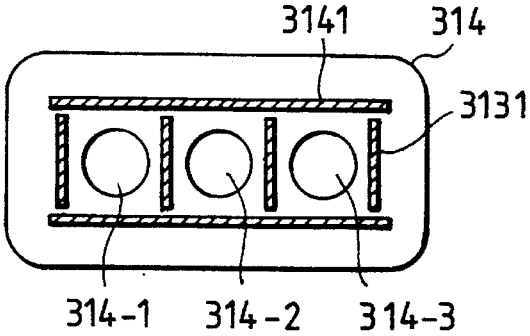
FIG. 3 is a sectional diagram taken along the line B—B of FIG. 1.

FIG. 1 is a longitudinal sectional diagram of important parts of a main lens unit for explaining a first embodiment of an electron gun provided to a cathode ray tube according to the present invention, FIG. 2 is a sectional diagram taken along the line A—A of FIG. 1, and FIG. 3 is a sectional diagram taken along the line B—B of FIG. 1.

In the respective diagrams, numeral 31 designates a third grid electrode composing a focusing electrode, numeral 32 designates a fourth grid electrode composing an accelerating electrode, numeral 33 designates a shield cup electrode. The focusing electrode 31 is composed of a group of electrodes comprising a first electrode member 311, a second electrode member 312, a third electrode member 313 and a fourth electrode member 314.

A constant first focusing voltage Vf1 is applied to the first electrode member 311 and the third electrode member 313, forming a first kind of focusing electrode group.

A second focusing voltage of a combination of a constant voltage Vf2 and a dynamic voltage dVf which changes in synchronism with the deflection of an electron beam is applied to the second electrode member 312 and the fourth electrode member 314, forming a second kind of focusing electrode group.

Further, a final accelerating voltage Eb of 20 through 30 kV is applied to the accelerating electrode 32 and the shield cup electrode 33.

A main lens is formed between the accelerating electrode 32 and the fourth electrode member 314. As has been disclosed in, for instance, Japanese Laid Open Patent Publication No. 103752/1983, the main lens is composed of a single aperture having a large diameter of an opposing face of an electrode, and electrode plates 321 and 3140 which are provided inside of the electrodes and which are provided with electron beam passing holes having an elliptic shape. According to the construction of the main lens, in comparison with a normal cylindrical lens, the lens aberration is reduced and the spot size of the electron beam on the screen can be reduced by the substantially enlarged lens diameter.

Further, in the embodiment of FIG. 1, a strong astigmatism is provided to the main lens wherein a focusing force in the horizontal direction is stronger than that in the vertical direction. In the structure which has been disclosed in the Japanese Laid Open Patent Publication No. 103752/1983, the astigmatism can freely be controlled by changing the positions of the electrode plates 321 and 3140 and the shapes of the electron beam passing holes.

As shown in FIGS. 2 and 3, an electrostatic quadrupole lens is formed in the third electrode member 313 and the fourth electrode member 314 composing the focusing electrode 31, by horizontal correction plates 3141 and vertical correction plates 3131. The structure of the electrostatic quadrupole lens is the same as the one disclosed in Japanese Laid Open Patent Publication No. 250939/1986. In this structure, the correction sensitivity of astigmatism can easily be increased by similarly prolonging the horizontal and the vertical correction plates.

Non-axisymmetric lenses are formed between the first electrode member 311 and the second electrode member 312, and between the second electrode member 312 and the third electrode member 313. In this example, a lens having a strong focusing force in the horizontal direction is formed by forming vertical slits 313-1, 313-2 and 313-3 as in the third electrode member 313 shown in FIG. 2, and by mutually opposing them to each other.

Whichever of the electric potentials of the first electrode member 311 (third electrode member 313) and the second electrode member 312 is higher than the other, a combination of the first slit lens composed of the first electrode member 311 and the second electrode member 312, and the second slit lens composed of the second electrode member 312 and the third electrode member 313 always produces the same effect that their total focusing strength is stronger in the horizontal direction than in the vertical direction.

On the other hand, in the electrostatic quadrupole lens, in a case wherein the electric potential of the third electrode member 313 is higher than that of the opposing fourth electrode member 314, the focusing force in the vertical direction is stronger. Conversely, in a case wherein the electric potential of the third electrode member 313 is lower than the electric potential of the opposing electrode, the focusing force in the horizontal direction is stronger.

Figure 4:
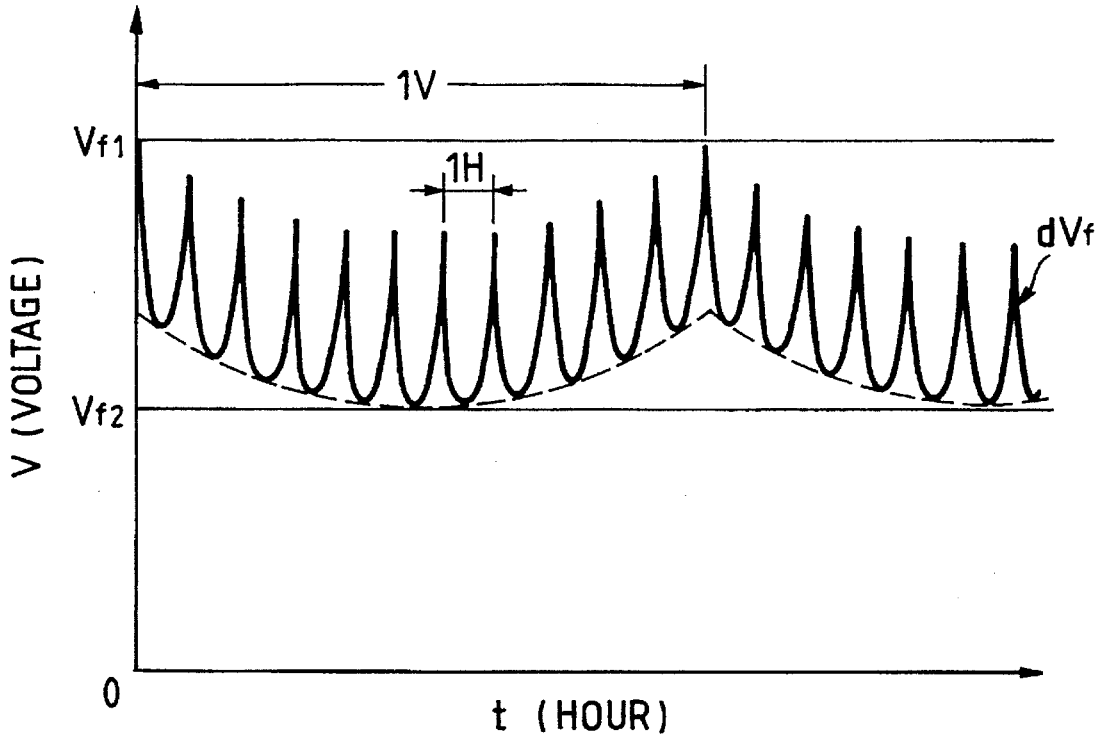
FIG. 4 is an explanatory diagram of a method of operating an electron gun according to the present invention.

FIG. 1 and FIG. 4 are explanatory diagrams of a construction and an operational method of an electron gun having, for instance, the above structure.

In FIG. 1, a first focusing voltage Vf1 of about 7 through 10 kV is applied to the first electrode member 311 and the third electrode member 313 composing a first kind of electrode group which composes the focusing electrode 31.

As shown in FIG. 4, a second focusing voltage of a constant voltage Vf2 of 6 through 9 kV that is lower than the direct voltage component of the first focusing voltage by about 1 kV, which is superposed with a dynamic voltage dVf, is applied to the second electrode member 312 and the fourth electrode member 314 composing a second kind of electrode group.

The dynamic correction voltage dVf has a waveform of a combination of a parabolic waveform having a period of a horizontal deflection period 1H of the electron beam and another parabolic waveform having a period of a vertical deflection period of 1 V. The peak-to-peak value of the dynamic correction voltage dVf is smaller than the difference between Vf1 and Vf2. Accordingly, the electric potential of the first kind of electrode group is always higher than that of the second kind of electrode group.

When the electron beam is not deflected and is at the center portion of the screen, the dynamic correction voltage is null, and the potential difference between the first kind of electrode group and the second kind of electrode group is maximized. Therefore, the lens actions of the electrostatic quadrupole lens and the slit lens are the strongest. At this moment, the astigmatism by the main lens and the slit lens which strongly focuses the electron beam in the horizontal direction, is cancelled by the astigmatism by the electrostatic quadrupole lens which strongly focuses the electron beam in the vertical direction.

When the electron beam is deflected to a corner portion of the screen, the dynamic correction voltage is maximized, and the potential difference between the first kind of electrode group and the second kind of electrode group is near to null. Accordingly, at the corner portion of the screen, the lens actions of both the electrostatic quadrupole lens and the slit lens are almost nullified.

At this moment, the astigmatism by the deflection of the electron beam which strongly focuses the electron beam in the vertical direction, is cancelled by the astigmatism by the main lens which strongly focuses the electron beam in the horizontal direction.

Further, the curvature-of-field aberration at the corner portion of the screen, is corrected by weakening the intensity of the main lens, and is further corrected by weakening of the vertical focusing strength of the quadrupole lens at the corner of the screen which strongly focuses the electron beam in the vertical direction at zero deflection.

Further, the curvature-of-field aberration is also corrected in the horizontal direction by the weakening of the horizontal focusing strength of the slit lens which strongly focuses the electron beam in the horizontal direction at the zero deflection.

In this way, the slit lens in this embodiment operates as complementing the effect of correcting the deflection aberration by the electrostatic quadrupole lens, and provides with little effect of restraining the effect of the electrostatic quadrupole lens in the vertical direction, as in the above conventional axisymmetric curvature-of-field correction lens. Accordingly, the correction efficiency is improved.

In comparison with the conventional technology, the deflection aberration is reduced by a simpler structure of the electron gun, and the improvement in the resolution at the peripheral portion of the screen can be achieved.

Further, this invention is not restricted to the color cathode ray tube which has been explained in the above embodiment, and is naturally applicable to a monochromatic cathode ray tube such as a projection type cathode ray tube, or other cathode ray tube.

Figure 7:
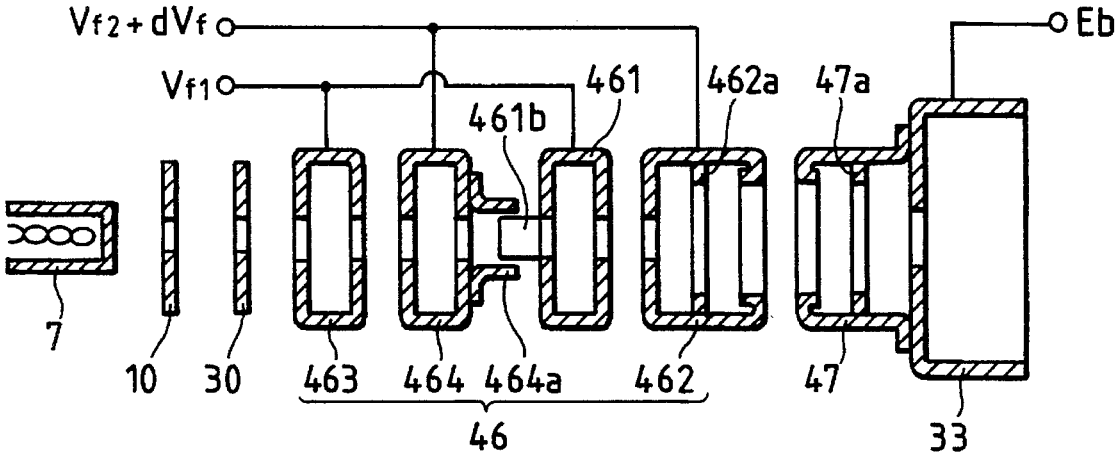
FIG. 7 is a longitudinal sectional diagram for explaining a structure of a second embodiment of an electron gun employed in a cathode ray tube according to the present invention.

FIG. 7 is a longitudinal section diagram for explaining a construction of a second embodiment of an electron gun employed in a cathode ray tube according to the present invention, wherein numeral 7 designates a cathode, numeral 10 designates a first grid electrode, numeral 30 designates a second grid electrode, numeral 46 designates a focusing electrode, numeral 47 designates an accelerating electrode and numeral 33 designates a shield cup.

In FIG. 7, the focusing electrode 46 is composed of a plurality of electrode members 461, 462, 463 and 464. Notations 461*b* and 464*a* designate astigmatism correction electrodes forming an electrostatic quadrupole lens. At the inside of the second electrode member 462, an internal electrode 462*a* is provided which has three electron beams passing holes having the same diameters in a direction in parallel with the horizontal plane and a direction orthogonal to the horizontal plane and which is electrically connected to the second electrode member 462. At the inside of the accelerating electrode 47, a center electron beam passing hole having an aperture or opening of which diameter in the vertical direction is larger than that in the horizontal direction and which is symmetrical in the horizontal direction, and side electron beam passing holes having an opening of which diameter in the vertical direction is larger than that in the horizontal direction and which is asymmetrical in the horizontal direction, are installed.

A triode is composed of the cathode 7, the first grid electrode 10 and the second grid electrode 30, and a main lens is formed between the accelerating electrode 47 on which the highest voltage is applied and the focusing electrode 46.

The focusing electrode 46 juxtaposed to the accelerating electrode 47, is divided into a first electrode member 461, a second electrode member 462, a third electrode member 463 and fourth electrode member 464. Correction electrodes 464*a* and 461*b* which form an astigmatism correction lens, are disposed between the first electrode member 461 and the fourth electrode member 464, and curvature-of-field correction lenses are disposed between the first electrode member 461 and the second electrode member 462, and between the third electrode member 463 and the fourth electrode member 464. Further, the curvature-of-field correction lens formed by the second electrode member 462 and the third electrode member 461 is juxtaposed to the main lens.

A constant voltage of Vf1 is applied to the first electrode member 461 and the third electrode member 463, and a dynamic correction voltage Vf2+dVf which changes in synchronism with a change of a deflection angle of a plurality of electron beams scanning on the screen, is applied to the second focusing electrode member 462 and the fourth electrode member 464.

Figure 8A:
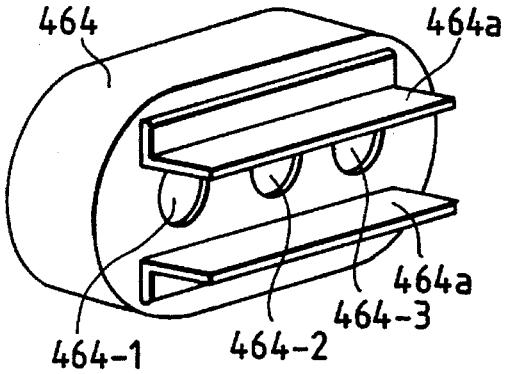
FIGS. 8*a* and 8*b* are explanatory diagrams of an example of a structure of a planar electrode for forming an astigmatism lens in FIG. 7.
Figure 8B:
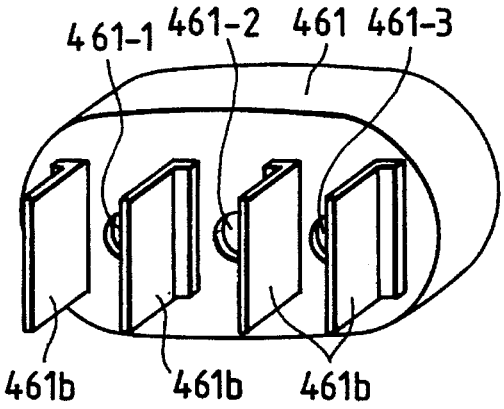

FIGS. 8*a* and 8*b* are explanatory diagrams of an example of a structure of planar electrodes forming an astigmatism lens which is disposed at the opposing portions of the first electrode member 461 and the fourth electrode member 464 composing the focusing electrode, wherein FIG. 8*a* is a perspective diagram of the fourth electrode member, and FIG. 8*b* is that of the first electrode member.

Openings 464-1, 464-2 and 464-3 for passing three electron beams are formed at an end face of the fourth electrode member 464 on the side of the first electrode member 461. A couple of planar electrodes 464*a* stand on the end face on the side of the first electrode member 461, such that they interpose the electron beam passing holes 464-1, 464-2 and 464-3.

Further, three electron beam passing holes 461-1, 461-2 and 461-3 for respectively passing three electron beams, are formed on an end face of the first electrode member 461 on the side of the fourth electrode member 464. A plurality of planar electrodes 461*b* stand on the end face on the side of the fourth electrode member 464 such that they interpose the electron beam passing holes 461-1, 461-2 and 461-3, respectively in the horizontal direction.

These planar electrodes 464*a* and 461*b* constitute an electrode structure which forms an electrostatic quadrupole lens for correcting the astigmatism arranged as shown in FIG. 7, when the both end faces of the first electrode member 461 and the fourth electrode member 464 oppose to each other.

Figure 9A:
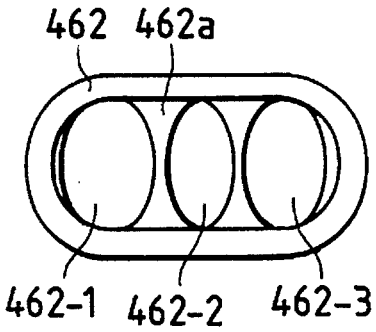
FIGS. 9*a* and 9*b* are front diagrams for explaining examples of shapes of inner electrodes installed respectively inside of a second electrode member composing a focusing electrode and an accelerating electrode.
Figure 9B:
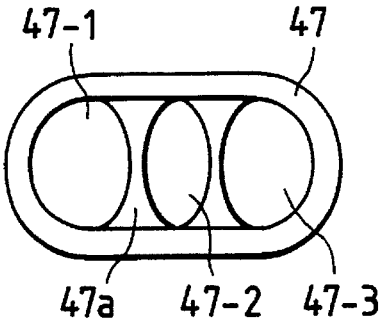

FIGS. 9*a* and 9*b* are front diagrams for explaining examples of shapes of inner electrodes which are installed respectively inside of the second electrode member and the accelerating electrode composing the focusing electrode, wherein FIG. 9*a* shows an inner electrode 462*a* which is installed in the second electrode member, and FIG. 9*b* shows an inner electrode 47*a* which is installed in the accelerating electrode.

As shown in these diagrams, the inner electrodes 462*a* and 47*a* which are respectively installed in the second electrode member 462 and the acceleration electrode 47, are provided with center electron beam passing holes 462-2 and 47-2 respectively having openings of which diameters in the vertical direction are larger than those in the horizontal direction and which are symmetrical in the horizontal direction, and side electron beam passing holes 462-1, 462-3, 47-1 and 47-3 having openings of which diameters in the vertical direction are larger than those in the horizontal direction and which are asymmetric in the horizontal direction.

Generally, in an electron lens for focusing beams emitted from the triode portion, the farther the electron lens is disposed from the triode portion toward the side of the luminescent screen, the stronger the lens effect. Accordingly, the effect of a curvature-of-field correction lens disposed proximate to the triode portion is reduced.

However, in this embodiment, the curvature-of-field correction lens which is the first electron lens, is disposed at a position contiguous to the main lens where the astigmatism correction lens (electrostatic quadrupole lens) which is the second electron lens, was disposed in the previous embodiment, thereby strengthening the correction effect. On the other hand, the correction effect of the astigmatism correction lens can be promoted by improvements in the structure such as increasing the lengths of the planar electrodes and therefore, the correction effect can be maintained even when it is disposed in a region proximate to the triode portion. Therefore, the astigmatism correction lens is disposed remote from the main lens and toward the triode portion compared with the curvature-of-field correction lens.

Figure 10:
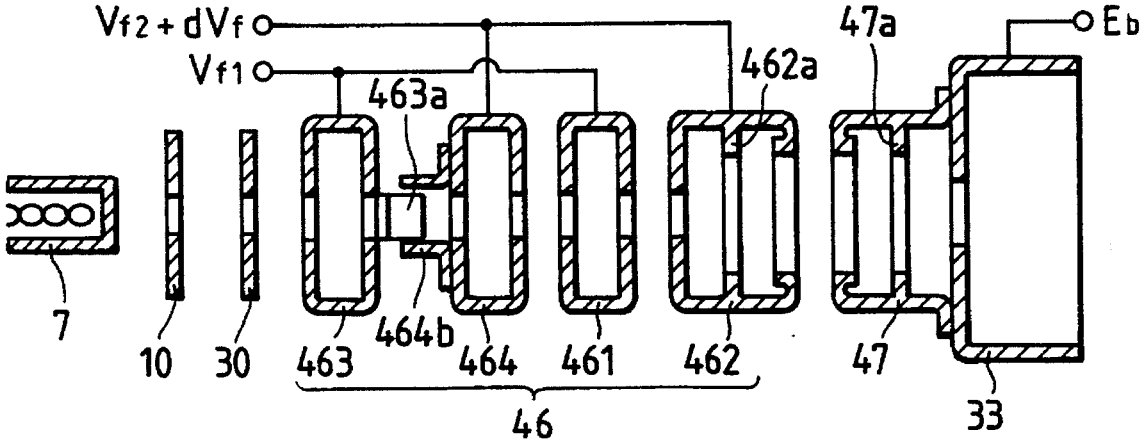
FIG. 10 is a longitudinal sectional diagram for explaining a structure of a third embodiment of an electron gun employed in a cathode ray tube according to the present invention.

FIG. 10 is a longitudinal sectional diagram for explaining a construction of a third embodiment of an electron gun employed in a cathode ray tube according to the present invention, wherein a notation which is the same as that in FIG. 7 corresponds to the same portion.

In FIG. 10, a focusing electrode 46 is divided into a first electrode member 461, a second electrode member 462, a third electrode member 463 and a fourth electrode member 464. Correction electrodes 463*a* and 464b which form an astigmatism lens, are disposed between the third electrode member 463 and the fourth electrode member 464. Two curvature-of-field correction lenses composed of the fourth electrode member 464 and the first electrode member 461, and the first electrode member 461 and the second electrode member 462, are disposed in the vicinity of the main lens.

Further, the inner electrode 462*a* disposed in the second focusing electrode 462 and the inner electrode 47*a* disposed in the accelerating electrode 47 are the same as in the former embodiment.

Also by the above construction, the correction effect of the curvature-of-field is promoted, an image having a high resolution is reproduced by favorably focusing the electron beam always over the whole region of the screen, without deteriorating the astigmatism correction effect, and the dynamic focus voltage can be reduced.

Further, an effect of the present invention can be provided in the respective embodiments, even when both the opposing electron beam passing holes of the electrode members composing the curvature-of-field correction lens are of axisymmetric shapes. Further, the following shapes are pertinent.

Figure 11A:
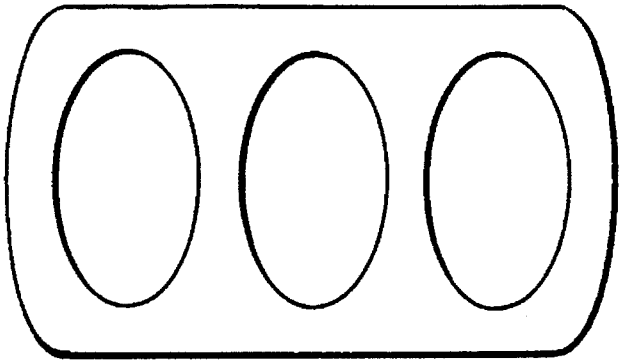
FIGS. 11*a*, 11*b* and 11*c* are explanatory diagrams of examples of shapes of opposing two electron beam passing holes of an electrode member composing a curvature-of-field correction lens.
Figure 11B:
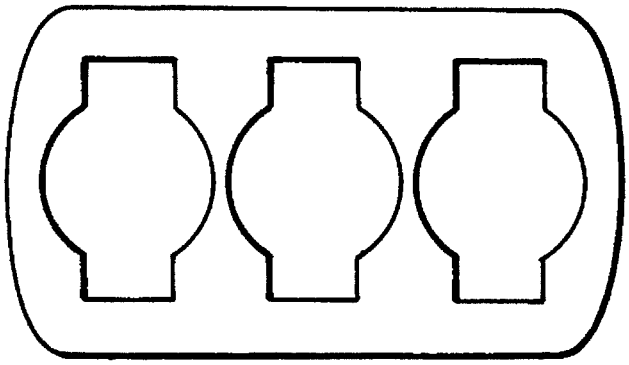
Figure 11C:
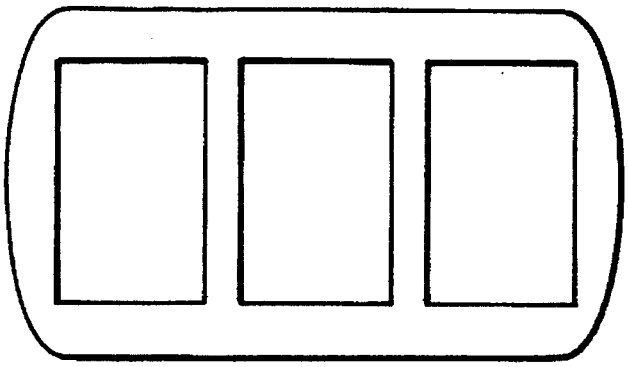

FIGS. 11*a* through 11*c* are explanatory diagrams of examples of shapes of opposing both electron beam passing holes of electrode members composing a curvature-of-field correction lens, wherein, illustrates FIG. 11*a*, electron beam passing holes having an elliptic shape with the long axis in the vertical direction, FIG. 11*b*, illustrates electron beam passing holes having a vertically elongated rectangular opening overlapped on a circular or vertically elliptical opening, and in FIG. 11*c* illustrates electron beam passing holes having a rectangular shape elongated in the vertical direction.

When the curvature-of-field correction lens is axisymmetric, the astigmatism correction by the electrostatic quadrupole lens in the horizontal direction has an effect of strengthening the focusing force for the electron beam, and the curvature-of-field correction by the main lens and the added lens has an effect of weakening the focusing force.

On the other hand, in the vertical direction, either one of the astigmatism correction and the curved image plane correction is in the direction of weakening the focusing force on the electron beam.

Accordingly, the above two kinds of lenses mutually weaken the effect in the horizontal direction, and mutually strengthen in the vertical direction.

Accordingly, the two kinds of the deflection aberration can effectively be corrected by rendering the curvature-of-field correction lens a non-axisymmetric lens with the shapes of the above openings, strengthening the focusing force in the horizontal direction and weakening it in the vertical direction, thereby promoting the sensitivity of the curvature-of-field correction in the horizontal direction and compensating for an amount of the effect is nullified by the electrostatic quadrupole lens.

Further, among the shapes of the openings of the electron beam passing holes shown in FIGS. 11*a* through 11*c*, the assembling is the easiest with the shape in the FIG. 11*b*, which is provided with an advantage wherein an assembly jig which has been employed conventionally, can be utilized as it is.

In the above respective embodiments, the sensitivities in the curvature-of-field correction are different. Therefore, the sensitivity of the curved image plane correction is matched to balance with the sensitivity of the astigmatism correction by the planar electrodes 461*b* and 464*a* (FIG. 7), or the planar electrode 464*a* and 461*b* (FIGS. 8*a* and 8*b*). The application of the focusing voltage remains the same as in FIG. 7.

By these constructions, the curvature-of-field correction effect is promoted, and the dynamic correction voltage for focusing the electron beam always over the whole region of the screen can be reduced.

As explained above, according to the present invention, a cathode ray tube can be provided wherein the correction sensitivity of the deflection aberration can be promoted by a comparatively simple structure of an electron gun, the manufacturing steps of the electron gun is simplified, and the cost reduction of a dynamic voltage forming circuit for correcting the deflection aberration can be achieved.

What is claimed is:

1. A cathode ray tube provided with at least an electron gun having an electron beam generating unit for generating a plurality of electron beams arrayed in a horizontal direction and for controlling said plurality of electron beams and a main lens unit for focusing said plurality of electron beams onto a fluorescent screen, and a deflection yoke for scanning said plurality of electron beams on said fluorescent screen, said main lens unit comprising:

electrode members constituting a first kind of a focusing electrode group adapted to be supplied with a first focusing voltage;

electrode members constituting a second kind of a focusing electrode group adapted to be supplied with a second focusing voltage; and an accelerating electrode disposed downstream of said first and second kind of focusing electrode groups and adapted to be supplied with an accelerating voltage;

at least two non-axisymmetric electron lenses being formed between one electrode member of said first kind of a focusing electrode group and one electrode member of said second kind of a focusing electrode group, respectively, including a first non-axisymmetric electron lens for focusing said plurality of electron beams stronger in a horizontal direction than in a vertical direction, and a second non-axisymmetric electron lens being a multipole lens for focusing said plurality of electron beams stronger in one of the horizontal and vertical directions and diverging said plurality of electron beams in another of the horizontal and vertical directions when said first focusing voltage is higher than said second focusing voltage, and for diverging said plurality of electron beams in said one of the horizontal and vertical directions and focusing said plurality of electron beams in said another of the horizontal and vertical directions when said first focusing voltage is lower than said second focusing voltage, thereby reversing a polarity of said multipole lens, at least one of said first and second focusing voltages being a voltage of a fixed voltage superposed with a dynamic voltage varying with a deflection amount of said plurality of electron beams; and a final main lens being formed between said accelerating electrode and one of said electrode members of said first and second kind of focusing electrode groups adjacent to said accelerating electrode for focusing said plurality of electron beams in both the horizontal and vertical directions and for focusing said plurality of electron beams stronger in the horizontal direction than in the vertical direction.

2. The cathode ray tube according to claim 1, wherein said second non-axisymmetric electron lens is an electrostatic quadrupole lens.

3. The cathode ray tube according to claim 1, wherein said electrode members constituting said first kind of a focusing electrode group and said electrode members constituting said second kind of a focusing electrode group are alternately arranged and the number of said electrode members constituting said respective first and second kind of focusing electrode groups is two.

4. The cathode ray tube according to claim 1, wherein one of said electrode members constituting said second kind of a focusing electrode group opposes said accelerating electrode.

5. A cathode ray tube provided with at least an electron gun having an electron beam generating unit for generating a plurality of electron beams arrayed in a horizontal direction and for controlling said plurality of electron beams and a main lens unit for focusing said plurality of electron beams onto a fluorescent screen, and a deflection yoke for scanning said plurality of electron beams on said fluorescent screen, said main lens unit comprising:

electrode members constituting a first kind of a focusing electrode group adapted to be supplied with a first focusing voltage;

electrode members constituting a second kind of a focusing electrode group adapted to be supplied with a second focusing voltage; and an accelerating electrode disposed downstream of said first and second kind of focusing electrode groups and adapted to be supplied with an accelerating voltage;

at least two non-axisymmetric electron lenses being formed between one electrode member of said first kind of a focusing electrode group and one electrode member of said second kind of a focusing electrode group, respectively, including a first non-axisymmetric electron lens for focusing said plurality of electron beams stronger in a horizontal direction than in a vertical direction, both mutually opposing surfaces of said electrode members of said first and second kind of focusing electrode groups constituting said first non-axisymmetric electron lens and being formed with openings therein having a vertical diameter larger than a horizontal diameter thereof, and a second non-axisymmetric electron lens being a multipole lens for focusing said plurality of electron beams stronger in one of the horizontal and vertical directions and for diverging said plurality of electron beams in another of the horizontal and vertical directions when said first focusing voltage is higher than said second focusing voltage, and for diverging said plurality of electron beams in said one of the horizontal and vertical directions and focusing said plurality of electron beams in said another of the horizontal and vertical directions when said first focusing voltage is lower than said second focusing voltage, thereby reversing a polarity of said multipole lens, at least one of said first and second focusing voltages being a voltage of a fixed voltage superposed with a dynamic voltage varying with a deflection amount of said plurality of electron beams; and a final main lens being formed between said accelerating electrode and one of said electrode members of said first and second kind of focusing electrode groups adjacent to said accelerating electrode for focusing said plurality of electron beams in both the horizontal and vertical directions and for focusing said plurality of electron beams stronger in the horizontal direction than in the vertical direction.

6. The cathode ray tube according to claim 5, wherein said second non-axisymmetric electron lens is an electrostatic quadrupole lens.

7. The cathode ray tube according to claim 2, wherein said electrode members constituting said first kind of a focusing electrode group and said electrode members constituting said second kind of a focusing electrode group are alternately arranged and the number of said electrode members constituting said respective first and second kind of focusing electrode groups is two.

8. The cathode ray tube according to claim 5, wherein one of said electrode members constituting said second kind of a focusing electrode group opposes said accelerating electrode.

9. A cathode ray tube provided with an electron gun having at least an electron beam generating unit for generating a plurality of electron beams arrayed in a horizontal direction and for controlling said plurality of electron beams and a main lens unit comprising a plurality of electrodes including focus electrode for focusing said plurality of electron beams onto a fluorescent screen and an accelerating electrode, said focus electrode being disposed adjacent to said accelerating electrode which is adapted to be supplied with a highest voltage, comprising a plurality of electrode members;

a first group of at least two of said plurality of electrode members constituting at least one first electron lens having a focusing action on said plurality of electron beams which increases in both the horizontal and vertical directions with an increasing difference between a first voltage applied on one member of said first group and a second voltage applied on another member of said first group, a second group of at least two of said plurality of electrode members constituting a second electron lens formed between end faces thereof other than end faces of said at least one first electron lens and being a multipole lens for focusing said plurality of electron beams in one of the horizontal and vertical directions and diverging said plurality of electron beams in another of the horizontal and vertical directions depending upon which is the higher of said first voltage which varies in synchronism with deflection of said plurality of electron beams and applied to one member of said second group and said second voltage having a fixed value and applied to another member of said second group, said at least one first electron lens being disposed at least between a final main lens and said second electron lens, said final main lens being formed between said accelerating electrode and one of said plurality of electrode members adjacent to said accelerating electrode for focusing said plurality of electron beams in both the horizontal and vertical directions and for focusing said plurality of electron beams stronger in the horizontal direction than in the vertical direction.

10. The cathode ray tube according to claim 9, wherein said second electron lens is an electrostatic quadrupole lens.

11. The cathode ray tube according to claim 9, wherein said electrode members constituting said first electron lens and said electrode members constituting said second electron lens are alternately arranged and the number of said electrode members constituting said respective first and second electron lenses is two.

12. The cathode ray tube according to claim 9, wherein a diameter in a vertical direction of both opposing apertures formed in two opposing electrode members of said electrode members constituting said first electron lens is larger than that in a horizontal direction.

* * * * *